United States Patent [19]

Ettinger

[11] 4,067,063

[45] Jan. 10, 1978

[54] PNEUMATIC ATHLETIC GUARD

[76] Inventor: Donald N. Ettinger, 6400 Lonas Drive, Apt. 213, Knoxville, Tenn. 37919

[21] Appl. No.: 563,488

[22] Filed: Mar. 31, 1975

[51] Int. Cl.[2] ..... A41D 13/00

[52] U.S. Cl. ..... 2/2; 2/16; 2/22; 2/413

[58] Field of Search ..... 2/16, 22, 24, 2, 3 R, 2/18, 20, 161 A, 413

[56] References Cited

U.S. PATENT DOCUMENTS

| | | | |
|---|---|---|---|
| 1,053,204 | 2/1913 | Morrison | 2/16 X |
| 1,146,742 | 7/1915 | Stillman | 2/18 |
| 1,391,753 | 9/1921 | Baier | 2/3 R |
| 1,399,584 | 12/1921 | Shelton | 2/24 |
| 2,124,158 | 7/1938 | Turner | 2/24 |
| 2,266,886 | 12/1941 | McCoy | 2/2 |
| 2,275,206 | 3/1942 | Sutherland | 2/18 |
| 2,609,537 | 9/1952 | Pfaff | 2/22 |
| 3,462,763 | 8/1969 | Schneider et al. | 2/3 R |

FOREIGN PATENT DOCUMENTS

| | | | |
|---|---|---|---|
| 104,584 | 7/1938 | Australia | 2/18 |

*Primary Examiner*—Werner H. Schroeder
*Assistant Examiner*—Peter Nerbun
*Attorney, Agent, or Firm*—Jenkins, Coffey & Hyland

[57] ABSTRACT

A protective pneumatic guard for athletes in contact sports comprising a valveless pneumatic pad bonded to one side of a foam cushion. The pad and cushion are retained by suitable means in a desired protective position against the wearer's body with the foam cushion outwardly presented to receive blows and to disperse them evenly over the surface area of the underlying pneumatic pad.

5 Claims, 6 Drawing Figures

PNEUMATIC ATHLETIC GUARD

BACKGROUND OF THE INVENTION

This invention relates to protective athletic equipment, and more specifically to a pneumatic guard for preventing injuries to players participating in contact sports.

Anyone who has ever played or watched the games of football, hockey, or any other body contact sport is aware of the heavy body contact involved and the resulting danger of injury to players. Since the early days of these contact sports, injuries have occurred all too frequently. Unfortunately, improved protective equipment items have often become available only after many serious injuries or even fatalities have occurred, and such protective items have usually not been completely effective in preventing injuries. For example, in football, substantial improvements have taken place over the years in the design of protective gear such as helmets and shoulder pads, but such improvements have not completely eliminated head and shoulder injuries. As a result of this continuing occurrence of injuries, manufacturers have been constantly pressured to design new and better protective athletic equipment.

In the design of any item of protective equipment, the primary goal is to protect the wearer against injury, or against aggravation of a previously incurred injury. Such a protective item allows a player to play to his full potential without fear of injury, or without fear of magnifying an existing injury. However, it is also desirable that no protective equipment item be usable by the wearer to inflict injury upon another player. For this reason, many organized athletic leagues have formed committees for establishing rules to govern equipment specifications and to ban those equipment items which might be dangerous.

The effect of equipment regulations is particularly noticeable in the games of football and hockey wherein a player is required to use his hands, arms, and legs to push or block an opponent. As a result, players are regularly subjected to painful and sometimes serious arm and leg bruises. Naturally, the use of protective equipment is encouraged, but many otherwise effective protective items are banned from use by equipment regulations because of their probable utility as weapons against an opposing player. For example, rules promulgated by a National Collegiate Athletic Association (N.C.A.A.) football committee expressly forbid the use of any hard or unyielding materials on a player's elbow, forearm, wrist, or hand because of the danger of injury to other players. Even tape and bandage is disallowed unless used for protecting existing injuries, and only after inspection and approval by a game official. Moreover, N.C.A.A. football rules prevent hard or unyielding materials from being used on a player's legs unless such materials are completely embedded within some type of relatively rigid padding.

As a result of equipment regulations, the development of hand and arm pads, elbow pads, thigh guards, knee pads, and the like has been extremely slow. Arm pads and the like have essentially been limited to soft sponge-like pads held by elastic wrapping next to the body area needing protection. See U.S. Pat. No. 3,073,209. Such sponge paddings partially absorb blows and pad the protected area, but they are not highly effective in distributing blows over a large area and thereby do not satisfactorily reduce the effects of the blows. Thigh pads and knee pads have been essentially restricted to slow recovery foam pads which offer only moderate protection against sharp blows. These slow recovery foam pads sometimes have a rigid shield encased therein for added protection, but such reinforced pads can be undesirably jolted against a player's leg to possibly cause an injury or aggravate an existing one. Accordingly, existing equipment has fallen far short of fulfilling the need for arm and leg protection. The unfortunate result is a continuance of arm and leg bumps and bruises which are often severe enough to warrant at least temporary removal of a player from competition.

Over the years, a wide variety of pneumatic devices has been proposed in an attempt to improve upon protective paddings. These pneumatic devices typically comprise an inflatable bag for use with some other item of protective equipment. For example, inflatable pneumatic devices have been suggested for use with football helmets in U.S. Pat. No. 2,150,290, and with shoulder pads in U.S. Pat. Nos. 1,757,019 and 2,247,961. Other inflatable devices such as thigh guards and pads for protecting injured areas have also been proposed. See U.S. Pat. Nos. 2,247,961 and 2,663,020. All of these prior art pneumatic devices, however, are directed to a bag having a valve to permit inflation. This valve undesirably provides a rigid or semirigid lump which, upon receipt of a blow, can be sharply driven against the supposedly protected area covered by the bag. The valve can penetrate into the protected area and cause painful aggravation of an existing injury, or even cause new injuries. Moreover, the valve as well as any seams in the pneumatic bag is often relatively weaker than the rest of the bag, and can fail upon a sharp blow to cause the bag to lose air and become ineffective. Because of these deficiencies, these previously available pneumatic devices have seldom been used by players, and accordingly, have not significantly improved upon protective paddings or reduced the occurrence of injuries.

The present invention overcomes the deficiencies of previously available protective paddings by providing a substantially improved pneumatic guard for protecting a wearer against injury. The present invention provides such an improved protective guard which complies with all equipment safety regulations, which is easy to wear without adding substantially to the weight or bulkiness of a player's equipment, and is both structurally simple and relatively inexpensive to manufacture.

SUMMARY OF THE INVENTION

In accordance with the invention, a pneumatic athletic guard is provided comprising a valveless pad of a lightweight and pliable material, and having a quantity of air permanently trapped therein. The pad has a size and shape to cover a desired portion of the wearer's body, and is fastened as by a suitable adhesive to one side of a protective covering such as a cushion.

The pad and cushion are positioned on the athlete by suitable means such as an elastic wrapping over the area in need of protection with the foam cushion facing outwardly for receiving blows and the pneumatic pad adjacent the wearer's body. The foam cushion maintains the shape of the pneumatic pad while evenly dispersing blows to said pad to effectively protect the wearer.

BRIEF DESCRIPTION OF THE DRAWINGS

The accompanying drawings illustrate the invention. In such drawings.

DETAILED DESCRIPTION OF THE PREFERRED EMBODIMENT

Figure 1:
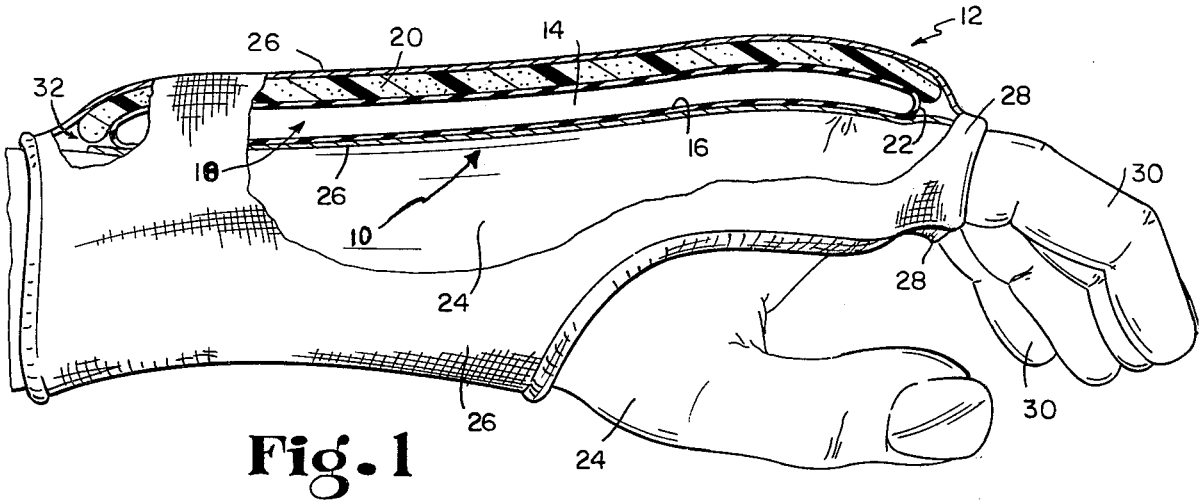
FIG. 1 is a fragmented side view of a protective athletic guard of this invention as it is embodied in a hand protector.
Figure 2:
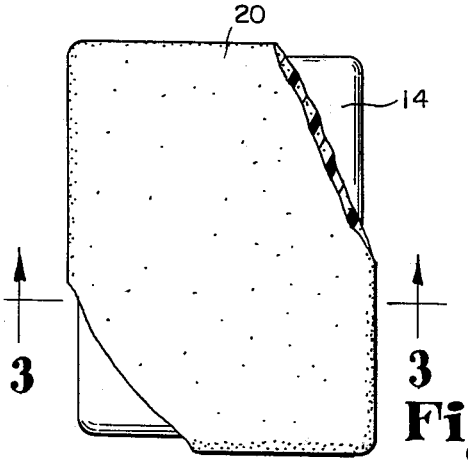
FIG. 2 is a fragmented plan view of the protective guard.
Figure 3:
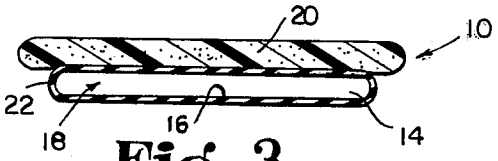
FIG. 3 is a horizontal section taken on the line 3—3 of FIG. 2.

A protective athletic guard 10 of this invention for use as a hand protector 12 for a football player is shown in FIGS. 1–3 of the drawings. The guard 10 comprises a pneumatic pad 14 formed from a strong but lightweight and pliable elastomeric material such as polyethylene or polypropylene. The pad 14 is rotationally molded in a conventional manner to have a seamless outer shell 16 of substantially uniform wall thickness, and a hollow interior 18. No valve is provided in the shell of the pad 14 so that a quantity of air is permanently trapped inside the pad during the molding process. The dimensions of the pad 14 are variable to meet any individual application. However, in the case of the hand protector shown in FIG. 1, the pad has a thickness of at least about three-eights inch and a length and width of approximately six inches by four inches to substantially cover the back of a player's hand.

The pneumatic pad 14 is connected as by a suitable adhesive to one side of a covering cushion 20 formed from a soft, resilient material such as foam rubber or the like. The cushion 20 has approximately the same thickness as the pneumatic pad 14 and a length and width slightly greater than the pad to slightly overlay and protect the four edges 22 of said pad. As shown, the pad 14 and the cushion 20 are supported in a protective position on the back of a player's hand 24 by an elastic wrapping 26. Conveniently, the wrapping 26 is a double-layered wrap shaped to fit over the player's hand with looped portions 28 for receiving the player's fingers 30 therethrough. A rearwardly open pocket 32 is formed between the wrapping layers for receiving the pad 14 and the cushion 20 with the pad lying adjacent the back of the player's hand 24 and the cushion presented outwardly.

In position, the pad 14 and cushion 20 together combine to protect the back of the player's hand 24 against bumps and bruises. The outwardly presented covering cushion serves to maintain the shape and approximate thickness of the pneumatic pad at all times, while being flexible enough to accommodate normal hand and wrist movements without restriction. The cushion receives any blows to the protected area, and partially absorbs those blows before evenly distributing them over the entire surface area of the pad. The pad provides a pneumatic shock absorber between the cushion 20 and the player's hand 24 to absorb blows and to evenly distribute them over a relatively broad area of the player's hand. Importantly, upon receipt of a blow, there are no pneumatic valves, lumps, or semirigid materials in either the pad or the cushion which could be driven into the player's hand and possibly cause injury or aggravate an existing injury. The pneumatic pad does not have any seams or other relatively weak wall portions which could break upon receiving a sharp blow. And further, the exterior of the pad 14 lies between the player's hand and the cover cushion 20 to fully protect said pad against punctures.

The protective pneumatic guard 10 of this invention can be conveniently sized and shaped, and positioned on a player by almost any suitable means to protect almost any desired portion of the player's body. For example, the length and width of the pad and cushion are widely variable according to the size of the area in need of protection. Elastic wrapping, tape, bandage, or the like can be used to position the guard against the wearer's body to form a protective wrist guard, elbow guard, forearm guard, knee guard, and so forth.

The protective guard 10 complies with existing athletic equipment safety regulations while providing substantially improved protection against injury. More specifically, the guard shown in FIGS. 1–3 has no hard or unyielding substances, and can thereby be worn by a player on any portion of his arms or legs to protect that player against injuries. Because the guard is soft and flexible, the wearer can use his arms and legs to combat an opponent without fear of injury to either himself or the opponent. Further, because the guard is both comfortable to wear and does not add to the weight or bulkiness of a player's equipment, the guard can be worn both to prevent new injuries and to protect old ones without affecting a player's ability to perform.

Figure 4:
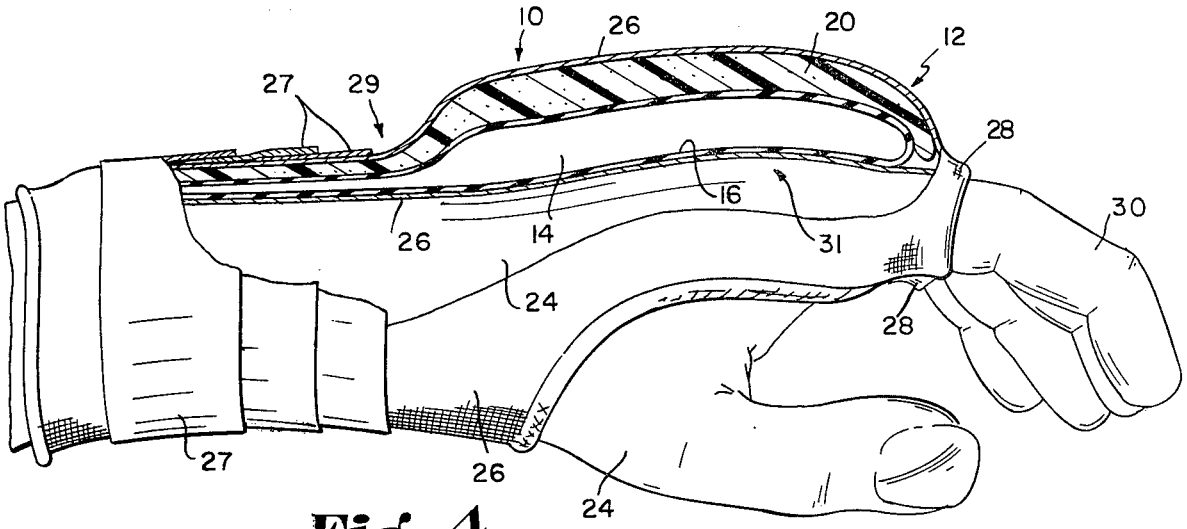
FIG. 4 is a fragmented side view of a modified form of the hand protector shown in FIG. 1.

The thickness of the pneumatic pad and thereby the degree of protection provided can, if desired, be varied along the pad's length and width. For example, in the hand protector shown in FIG. 4, tape 27 is tightly wrapped about the player's wrist at the rear of the pad 14, as at 29, to to force a major portion of the air trapped in the pad to a position over the knuckle area 31 of the player's hand 24. This effectively increases the thickness of the pneumatic pad over the knuckle area to add extra protection to that area. This is especially important when the guard is used by a player to protect a previously incurred injury, such as a broken knuckle.

Figure 5:
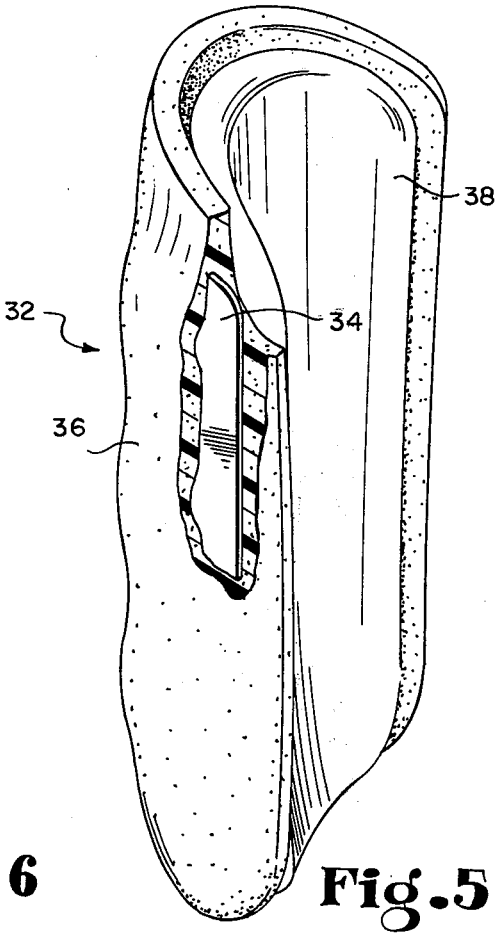
FIG. 5 is a fragmented perspective view of the protective guard of this invention as it is embodied in a protective thigh guard.

An alternate embodiment of the protective guard of this invention is shown in FIG. 5, and generally comprises a protective thigh guard 32. As shown, the guard 32 comprises a relatively rigid concavo-convex shield 34 contoured to generally fit over the front portion of a player's thigh. The shield 34 is formed from any suitable material such as a high impact plastic and is totally encased within a similarly shaped protective covering 36. The protective covering 36 is formed from slow recovery foam or the like, and has a valveless pneumatic pad 38 fastened to the concave side thereof by a suitable adhesive. The pad 38 is formed from a pliable elastomeric material, and is rotationally molded to be seamless and to have a quantity of air permanently trapped therein. The pad has a thickness of from about ½ inch to about 1½ inches, and is shaped to fit over the front portion of a player's thigh.

The thigh guard 32 is retained in a protective position over the thigh of a player in any convenient manner. For example, the guard can be positioned by an elastic wrapping, tape, or bandage wrapped about the guard and the player's leg. Alternately, the guard can be positioned within a pocket formed in the leg of the player's uniform. In a protective position, the convex side of the protective covering 36 is outwardly presented to receive blows for transferral to the pneumatic pad 38. The blows are evenly distributed over the surface area of the pad, and thereby also over a wide area of the player's leg to provide effective protection against injury. The air shock absorber provided by the pneumatic pad 38 thereby provides greatly improved absorption and dissipation of blows as well as preventing the player's leg from being jolted and possibly injured by the relatively stiff covering 36 and shield 34. And, the pneumatic pad contains no valves which can be driven into the player's leg to cause injury, or any seams or other weak points which can fail upon receipt of a blow.

Figure 6:
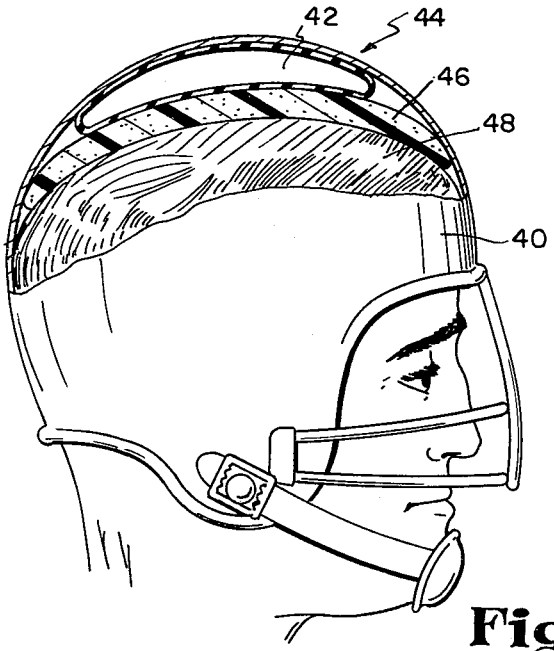
FIG. 6 is a fragmented elevation view of the guard mounted in a protective helmet.

A protective guard of this invention can be incorporated into almost any item of protective equipment to improve the ability of that equipment item to protect the wearer against injuries resulting from player body contact. For example, as shown in FIG. 6, the guard is combined with a protective helmet 40 to provide improved protection against head injuries. As shown, a valveless and seamless pneumatic pad 42 having a quantity of air trapped therein is conveniently sized and shaped to fit within the crown portion 44 of the helmet 40. The pad 42 is fastened on one side by an adhesive material to the underside of the helmet and on the other side to a foam cushion 46. Thus, the player's head 48 is insulated from the hard helmet material by the foam cushion 46 and the pneumatic pad 42, with blows to the player's head being distributed evenly over the wide surface area of said pad. As before, the pad 42 has no weak valve or seam portion which can fail, and no valves or other lumps which can penetrate into the player's head to cause injury. Also, while the pad and cushion are shown received in the crown 44 of the helmet, said pad and cushion can be sized and shaped to fit within almost any portion of the helmet to effectively absorb blows and protect the wearer.

I claim:

1. A protective guard for an athlete, comprising a valveless, seamless pneumatic pad having a quantity of gas trapped therein; a protective cushion mounted on one side of said pad and having generally the same size and shape thereof; positioning means for retaining said pad and cushion in a protective position on the athlete with said pad adjacent the athlete's body and said cushion presented outwardly for receiving blows, said cushion serving to maintain the shape of said pad and to distribute blows evenly to, and means received about a portion of said pad for selectively creating localized variations in pad thickness when tightened.

2. A protective guard for an athlete as set forth in claim 1 wherein said protective cushion has a length and width slightly greater than the length and width of said pad so that said cushion slightly overlays and protects the edges of said pad.

3. A protective guard for an athlete, comprising a valveless, seamless elastomeric pneumatic pad having an uninterrupted exterior surface and a substantially uniform wall thickness, said pad having a substantially uninterrupted hollow interior in which a quantity of air is trapped during formation of said pad , said air being trapped in said pad at substantially atmospheric pressure; a resilient cushion adhesively mounted on one side of said pad to maintain the shape thereof, said cushion having generally the same size and shape of said pad with a length and width slightly greater than the length and width of said pad so that said cushion overlays and protects the edges of said pad; and elastic positioning means having a pocket formed therein for receiving and retaining said pad and cushion in a protective position on the athlete with said pad adjacent the athlete's body and the cushion presented outwardly for receiving blows and for distributing said blows evenly to said pad.

4. A protective guard for an athlete as set forth in claim 3 wherein said pad and said cushion respectively have a thickness of from about three-eighths inch to about one and one-half inches.

5. A protective guard for an athlete as set forth in claim 3 wherein said cushion comprises a foam cushion having a relatively rigid shield encased therein.

* * * * *

UNITED STATES PATENT OFFICE

CERTIFICATE OF CORRECTION

Patent No. 4,067,063 Dated January 10, 1978

Inventor(s) Donald N. Ettinger

It is certified that error appears in the above-identified patent and that said Letters Patent are hereby corrected as shown below:

Column 6, line 6, change "to" to --thereto--.

Signed and Sealed this

Sixth Day of June 1978

[SEAL]

*Attest:*

RUTH C. MASON
*Attesting Officer*

DONALD W. BANNER
*Commissioner of Patents and Trademarks*